US007753233B2

(12) United States Patent
Umenaka

(10) Patent No.: US 7,753,233 B2
(45) Date of Patent: Jul. 13, 2010

(54) SPOUT UNIT AND BAG USING THE SAME

(75) Inventor: Kazuhiro Umenaka, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 224 days.

(21) Appl. No.: 11/950,590

(22) Filed: Dec. 5, 2007

(65) Prior Publication Data

US 2008/0135513 A1 Jun. 12, 2008

(30) Foreign Application Priority Data

Dec. 7, 2006 (JP) ..... 2006-330869

(51) Int. Cl.
*B65D 35/00* (2006.01)

(52) U.S. Cl. ..... 222/107; 215/252; 383/80

(58) Field of Classification Search ..... 222/107, 222/106, 92, 105; 215/252, 901, 256, 258; 383/93, 210, 204, 36, 906, 80
See application file for complete search history.

(56) References Cited

U.S. PATENT DOCUMENTS

| | | | | |
|---|---|---|---|---|
| 5,040,692 | A * | 8/1991 | Julian | 215/252 |
| 5,056,675 | A * | 10/1991 | Julian | 215/252 |
| 5,720,402 | A | 2/1998 | May | |
| 5,853,095 | A * | 12/1998 | Marshall et al. | 215/252 |
| 6,116,443 | A * | 9/2000 | Parrinello | 215/252 |

FOREIGN PATENT DOCUMENTS

| | | | |
|---|---|---|---|
| EP | 1728726 | * 12/2006 | 215/252 |
| JP | 10-181758 | * 7/1998 | 222/107 |
| JP | 2001-233364 | 8/2001 | |
| JP | 2001233364 | 8/2001 | |

(Continued)

OTHER PUBLICATIONS

European Search Report: Application No./Patent No. 07122414.1-1261.

*Primary Examiner*—Lien T Ngo
(74) *Attorney, Agent, or Firm*—Ladas & Parry LLP

(57) ABSTRACT

A spout unit having a tamper-evident function so that it is easy to determine visually that a sealed cap is opened when the cap is unsealed, wherein strong force is not needed to open while modification of moderate curve in convex from an easy-to-break portion of a tamper-proof ring is corrected when the spout is sealed with the cap, is provided. A spout unit comprising a spout 20 having a cylindrical opening 21 and a cap 2 which seals the opening of the spout, wherein the cap 2 has a tamper-proof ring 10 connected to a lower end portion of the cap 2 via an easy-to-break linking piece; wherein the tamper-proof ring has an easy-to-break portion 14, which breaks by tension applied in the circumferential direction of the ring, and a claw part engageable with a ratchet provided at the spout side; and wherein a tamper-proof ring support 45 is provided at least at two points around the opening of the spout, in which the tamper-proof ring support is in partial contact with undersurface of the tamper-proof ring upon screwing the cap and has a height to maintain a position of the tamper-proof ring in horizontal direction at a constant level.

6 Claims, 14 Drawing Sheets

1

FOREIGN PATENT DOCUMENTS

| | | |
|---|---|---|
| JP | 2004-051195 | 2/2004 |
| JP | 2004051195 | 2/2004 |
| JP | 2005-271922 | 10/2005 |
| JP | 2005271922 | 10/2005 |
| WO | 97/33800 | 9/1997 |
| WO | 98/16436 | 4/1998 |
| WO | 03/018415 | 3/2003 |

* cited by examiner

SPOUT UNIT AND BAG USING THE SAME

BACKGROUND OF THE INVENTION

1. Field of the Invention

The present invention relates to a spout unit having a tamper-evident (tamper-proof) function projected at a discharge position of a container used for a beverage, a seasoning and so on.

2. Description of the Related Art

Conventionally, various kinds of containers, for example, a flat bag, a gusset bag, a bottle and so on are known as a container to be filled with an inner content such as beverage, seasoning or the like. For example, as shown in FIG. 13, a container equipped with a spout unit 101 comprising a cap 102 and a spout 120 has been used in a wide field of commercial product.

However, when the container having the spout unit is accidentally or intentionally opened in a distribution process or a sales situation, virginity of product may be deteriorated or an inner content of product may be falsified. It is hard to judge if commercial value is damaged by appearance of the product. As a countermeasure, a spout unit having a tamper-evident (tamper-proof) function has been used.

As the spout unit having a tamper-proof function, a spout unit which is designed so that break of a seal of a cap can be easily judged visually from a separated condition of a tamper-proof ring, wherein the tamper-proof ring is connected to a lower end portion of peripheral wall of a cap body and a thin fragile portion is provided in a part of the tamper-proof ring so that the break of a seal can be easily confirmed visually once the cap is open, thereby, when the sealed cap is rotated in the unsealing direction, the thin fragile portion becomes a break part and breaks.

In a general structure of the spout unit having the tamper-proof function, a spout unit comprises a cap in which a tamper-proof ring having a claw part is connected with a lower end portion a peripheral wall of a cap body, and a spout having a ratchet engageable with the claw part of the tamper-proof ring. In a part of the tamper-proof ring, a thin fragile portion, which can be a break part when the cap is to be opened, is provided.

Upon opening the sealed cap of the spout unit having the above structure, firstly, the cap is rotated in the unsealing direction (anticlockwise rotation around an ax of the cap) with respect to the spout of the cap, thereby, the claw part of the tamper-proof ring engages with the ratchet of the spout. From this condition, when the cap is further rotated in the unsealing direction, tension which works in the circumferential direction of the tamper-proof ring occurs so that the thin fragile portion provided to the tamper-proof ring becomes the break part and breaks.

Japanese Patent Application Laid-Open (JP-A) No. 2001-233364 discloses a tamper-evident cap device wherein a positioning protrusion, which sets out a fix-completion position of the cap, is provided at a container opening, and a bridge portion is provided between a cap body and a tamper-evident ring so that the bridge portion is located lateral to the positioning protrusion; and wherein when the cap body is separated from a neck part of the container, the bridge portion is cut off, thereby, separation of the cap is easily visible.

JP-A No. 2004-51195 discloses an unseal confirmation structure of a cap, wherein claw parts are arranged so that when a claw part is in a position that engages with a ratchet, an other claw part is in a position that does not engage with the ratchet, thereby, the claw part and the ratchet are surely engaged and a V-formed cutout provided at a part of a tamper-proof ring becomes a break part to be separated.

JP-A No. 2005-271922 discloses a movable cap having a tamper-evident (tamper-proof) function, wherein a tamper-proof ring is connected underneath a cap body, a connection piece (thin fragile portion), which connects ring pieces constituting the tamper-proof ring, is provided at least at one part of the ring piece, and the connection piece becomes a break part to be separated when opened.

The tamper-proof ring is made of a flexible and easy-to-break material, normally plastic, and partially has one of more easy-to-break portions, which are low in strength, in the ring circumferential direction so that the claw part can go over the ratchet when screwing the cap into the opening to close, and the ring can be broken in the ring circumferential direction by tension when rotating the cap in the unsealing direction to remove the cap from the opening.

As such a cap equipped with the tamper-proof ring is screwed into the opening of the spout, the flexible tamper-proof ring is slightly subject to plastic deformation when the ring goes over the ratchet so that the ring diameter increases. Thereby, as shown in FIG. 14, the tamper-proof ring 110 descends in the right and left directions from the easy-to-break portion of the tamper-proof ring 110 so that the tamper-proof ring 110 is distorted moderately curving in convex when viewed edge-on. Hence, there is a problem of deteriorating commercial value in appearance.

The moderate curve in convex (slightly shallow arc) is naturally corrected if there is no gap between the lower-end portion of the tamper-proof ring 110 and a base 124 beneath the opening of the spout when the cap 102 is screwed to the lowest of the opening. However, in such a case that the gap is not secured, since the lower-end portion of the tamper-proof ring 110 and the upper surface of the base 124 of the spout are closely contacted when the cap 102 is screwed to the lowest of the opening and friction resistance increases upon unsealing, significantly strong force is needed to unseal, thus it is inconvenient.

Also, if no gap is secured between the lower-end portion of the tamper-proof ring 110 and the base 124 of the spout when the cap 102 is screwed to the lowest of the opening, the form of the tamper-proof ring is corrected when, after unsealing, the cap is screwed again into the opening to re-seal, which makes it difficult to distinguish whether the ring has already been broken or not. Therefore, it is likely that unseal-warning function of the tamper-proof ring 110 is not fully exhibited.

An object of the present invention is to provide a spout unit having a tamper-evident (tamper-proof) function so that it is easy to determine visually that a sealed cap is opened when the cap is unsealed, wherein strong force is not needed to open while modification of moderate curve in convex (slightly shallow arc) from an easy-to-break portion of a tamper-proof ring is corrected when the spout is sealed with the cap.

SUMMARY OF THE INVENTION

A spout unit according to the present invention comprises a spout having a cylindrical opening and a cap which screws into the opening of the spout to seal the opening, wherein the cap has a cylindrical cap body and a tamper-proof ring connected to a lower end portion of a skirt part of the cap body via an easy-to-break linking piece;

wherein an easy-to-break portion, which breaks the ring by tension applied in the circumferential direction of the ring, is provided at least at a part of the tamper-proof ring, and a claw part is provided at least at one point of inner circumference surface of the tamper-proof ring; and wherein a ratchet engageable with the claw part of the tamper-proof ring when rotating the cap of sealed condition in the unsealing direction is provided around the opening of the spout, and a tamper-proof ring support is provided at least at two points around the opening, in which the tamper-proof ring support is in partial contact with undersurface of the tamper-proof ring upon screwing the cap and has a height to maintain a position of the tamper-proof ring in horizontal direction at a constant level.

In one embodiment of the present invention, the easy-to-break portion of the tamper-proof ring may be formed to have a missing part in the width and/or thickness direction of the ring.

In one embodiment of the present invention, the spout may have the opening, a base comprising one or more flanges which stretches horizontally at a lower part of the outer circumference surface of the opening, and a stopper which stretches horizontally at a higher position than the base of the outer circumference surface of the opening; the ratchet may be provided at an outer edge of the stopper and/or between the stopper and the base; and the tamper-proof ring support may be provided on the base.

In one embodiment of the present invention, the stopper may be in a form of a pair of fans stretching out right and left from the outer circumference surface of the opening.

In one embodiment of the present invention, a lower end portion of a skirt part of the cap body and the tamper-proof ring are connected with the easy-to-break linking piece in some part and with a noncleavable linking piece in other part; and the tamper-proof ring may be connected to the lower end portion of the skirt part of the cap body by:

the easy-to-break linking piece at rearward side of the easy-to-break portion when the cap sealing the spout is rotated in the unsealing direction and at a relatively proximal position to the easy-to-break portion, and the noncleavable linking piece at rearward side of the easy-to-break portion when the cap sealing the spout is rotated in the unsealing direction and at a position which is farther than the easy-to-break linking piece.

In one embodiment of the present invention, the spout for the cap may further have an elongate cylindrical straw part beneath the opening.

A bag according to the present invention is a bag comprising a spout unit of the present invention and a bag body connected with the spout unit.

According to the spout unit provided by the present invention, break of a seal of the cap can be easily judged visually from a separated condition of the easy-to-break portion provided at a part of the tamper-proof ring when the sealed cap is opened.

Also, according to the spout unit, as the tamper-proof ring support provided to the base of the spout supports the tamper-proof ring from beneath when the spout is sealed with the cap, modification of moderate curve in convex (slightly shallow arc) from the easy-to-break portion is corrected. Moreover, since the tamper-proof ring support only contacts with a partial region of the bottom end of the tamper-proof ring, friction resistance upon unsealing does not excessively increase. Therefore, the spout unit having the tamper-proof function with high commercial value is provided.

BRIEF DESCRIPTION OF THE DRAWINGS

In the accompanying drawings.

The numerical symbol in each figure refers to the following: 1: spout unit, 2: cap, 3: cap body, 4: disk-shaped top portion, 5: internal thread, 6: annular protrusion, 7: knurl, 8: skirt part, 8*a*: tapered form, 9: lower end portion of skirt part, 10: tamper-proof ring, 11: ring piece, 12: easy-to-break linking piece, 13: noncleavable linking piece, 14: easy-to-break portion, 15: claw part, 16: claw part, 17: bottom portion of tamper-proof ring, 20: spout, 21: opening, 22: external thread, 23: stopper, 24: base flange, 25: base flange, 26: base flange, 27: mounting part, 28: straw part, 29: aperture, 30: long hole, 31: plate member, 40: rib, 41: ratchet, 42: rib, 43: ratchet, 44: rib, 45: tamper-proof ring support, and 46: rib.

DETAILED DESCRIPTION OF THE INVENTION

A spout unit of the present invention comprises a spout having a cylindrical opening and a cap which screws into the opening of the spout to seal the opening, wherein the cap has a cylindrical cap body and a tamper-proof ring connected to a lower end portion of a skirt part of the cap body via an easy-to-break linking piece;

wherein an easy-to-break portion, which breaks the ring by tension applied in the circumferential direction of the ring, is provided at least at a part of the tamper-proof ring, and a claw part is provided at least at one point of inner circumference surface of the tamper-proof ring; and wherein a ratchet engageable with the claw part of the tamper-proof ring when rotating the cap of sealed condition in the unsealing direction is provided around the opening of the spout, and a tamper-proof ring support is provided at least at two points around the opening, in which the tamper-proof ring support is in partial contact with undersurface of the tamper-proof ring upon screwing the cap and has a height to maintain a position of the tamper-proof ring in horizontal direction at a constant level.

Figure 1:
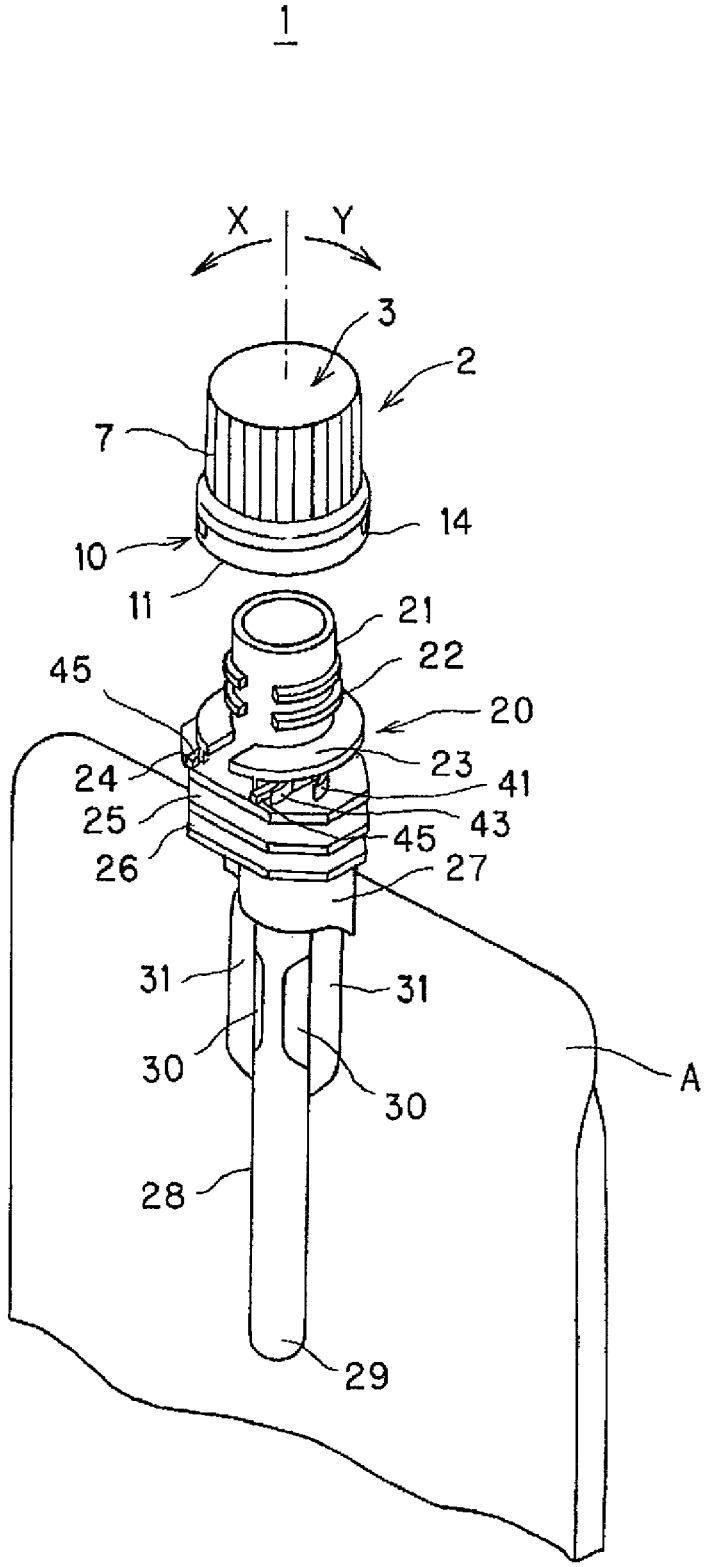
FIG. 1 is a perspective view showing one example of a bag having a spout unit of the present invention.
Figure 2:
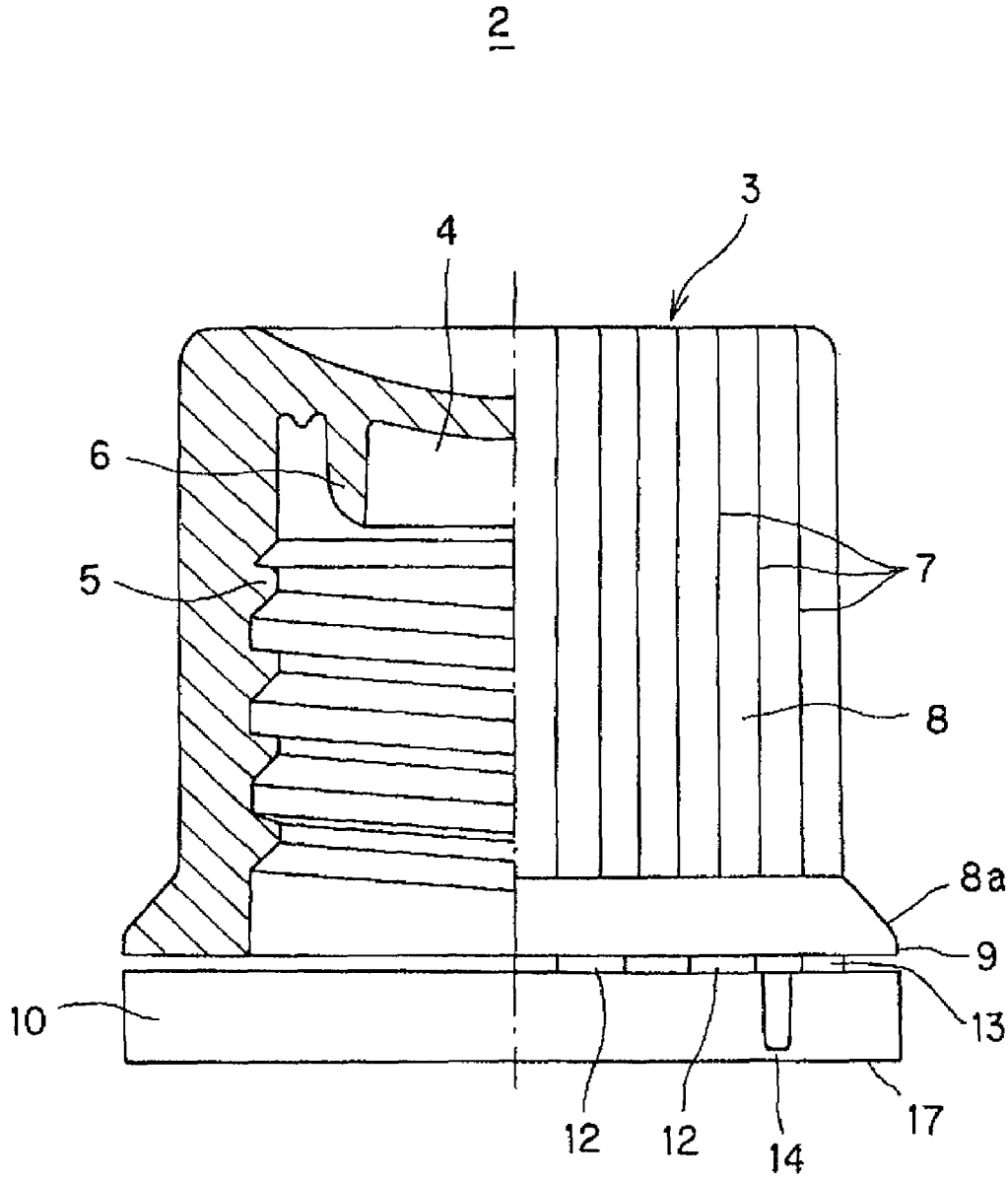
FIG. 2 is a partial front view showing a cap constituting a spout unit of the present invention and a partial longitudinal section view of the cap.
Figure 3:
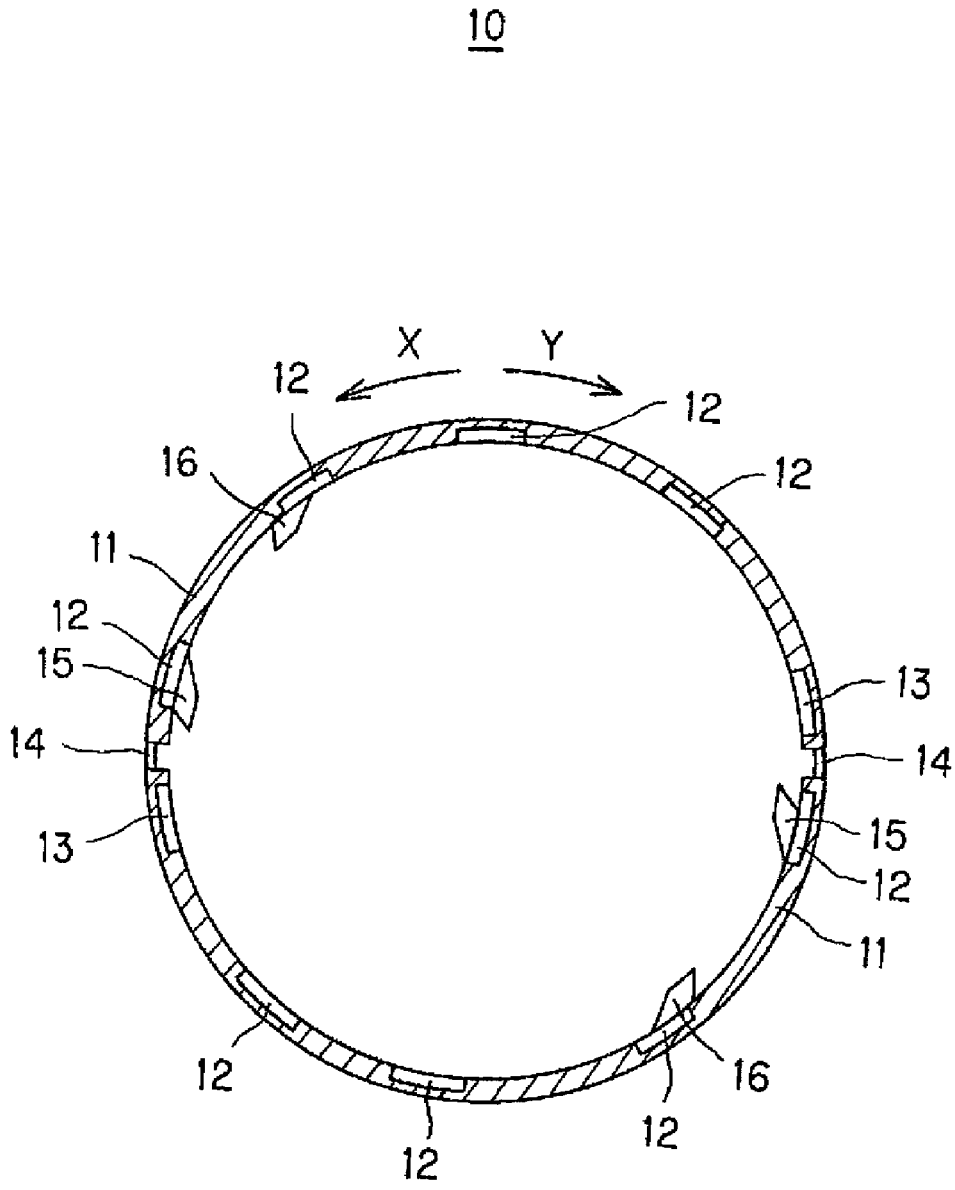
FIG. 3 is a cross-sectional view viewing a tamper-proof ring constituting a spout unit of the present invention from above.
Figure 11A:
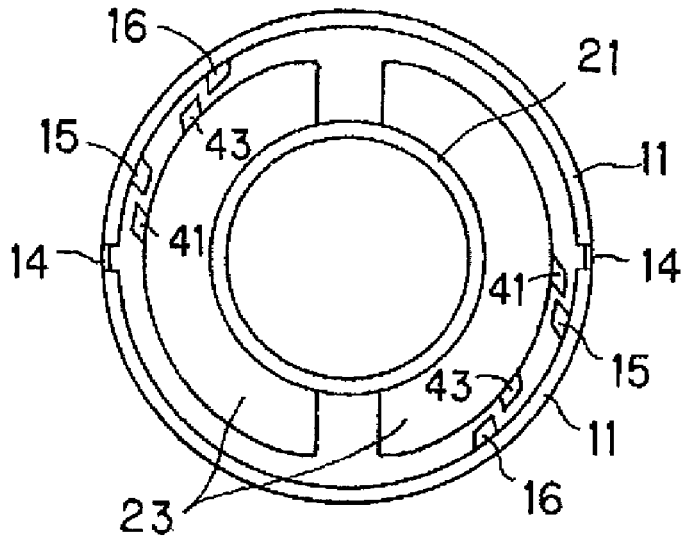
FIG. 11A is a view showing a state of a tamper-proof ring of a spout unit of the present invention when sealed.
Figure 11B:
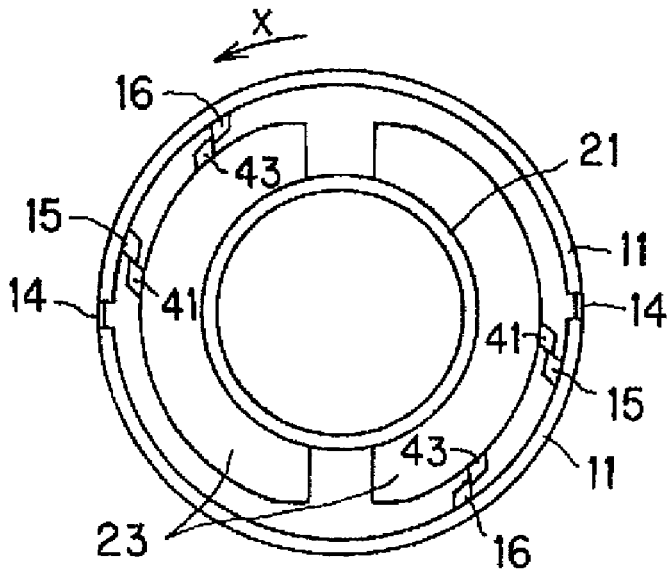
FIG. 11B is a view showing a state of a tamper-proof ring wherein a claw part and a ratchet are engaged in a stage of open process of a spout unit of the present invention.
Figure 11C:
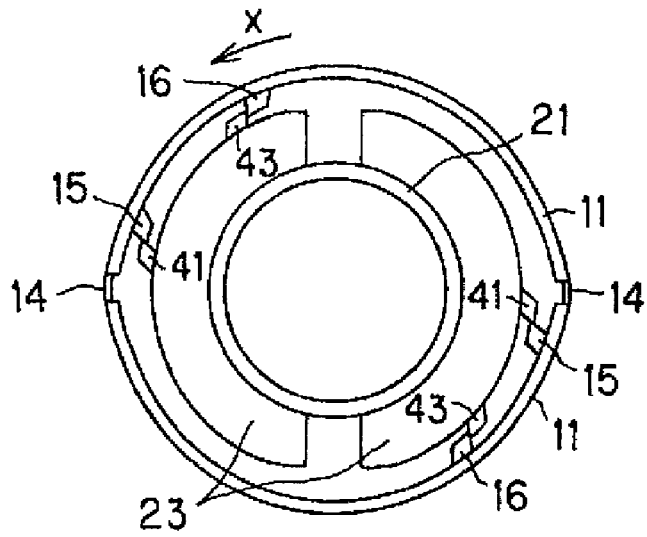
FIG. 11C is a view showing a state of a tamper-proof ring to which tension is applied in a stage of open process of a spout unit of the present invention.
Figure 11D:
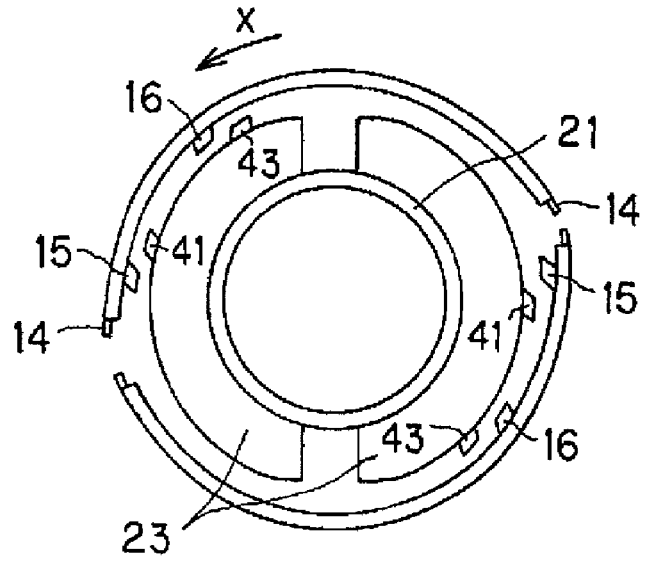
FIG. 11D is a view showing a state of a tamper-proof ring which breaks in a stage of open process of a spout unit of the present invention.
Figure 12:
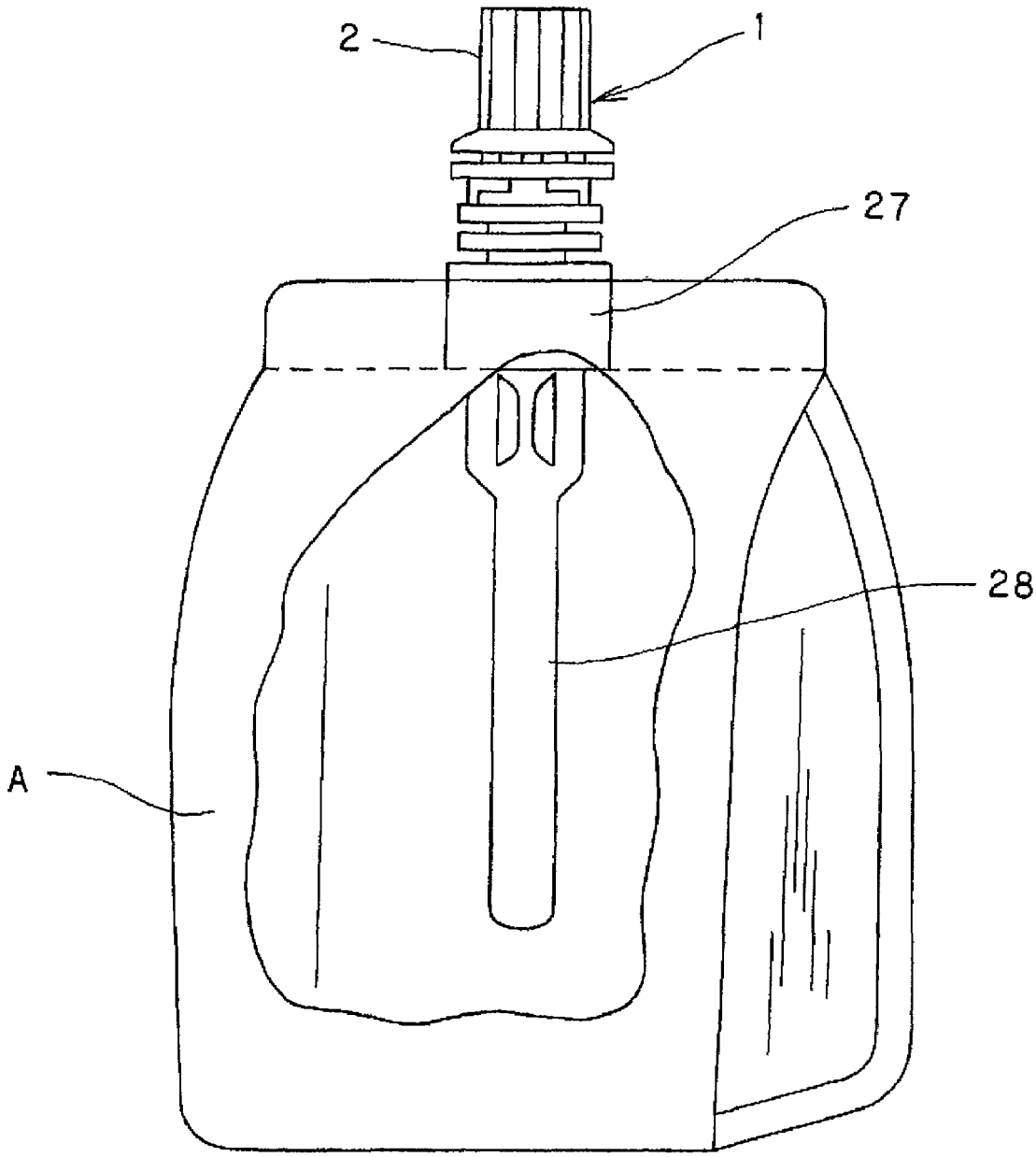
FIG. 12 is a perspective view showing one example of a bag having a spout unit of the present invention.
Figure 13:
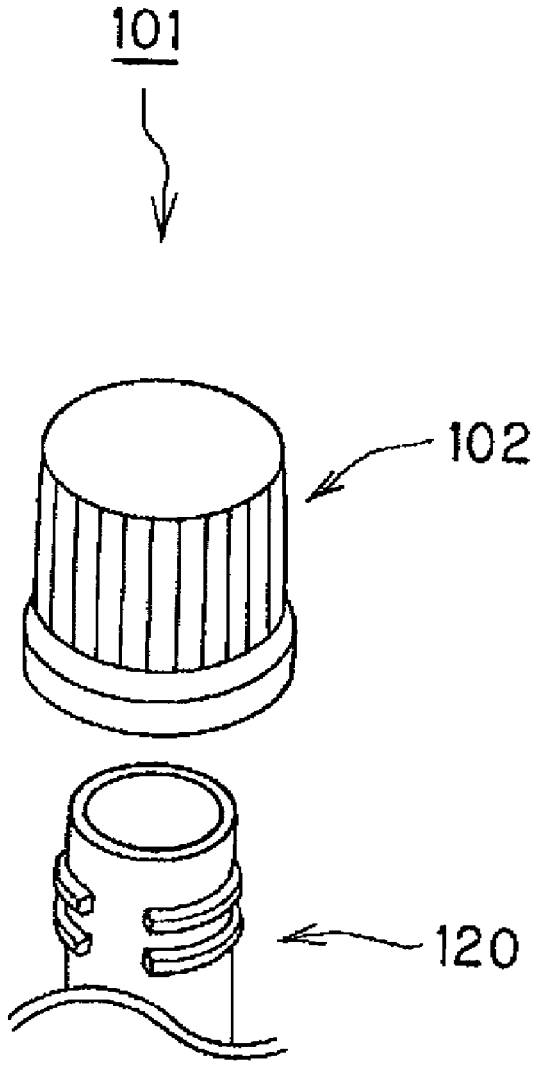
FIG. 13 is a perspective view showing a conventional spout unit.

FIGS. 1 and 12 are perspective views showing one example of a bag having a spout unit of the present invention. FIGS. 2 to 4 are concerning constitutions of the spout unit. FIGS. 5 to 10 are concerning a spout constituting the spout unit. FIGS. 11A to 11D are concerning an open process of the spout unit. Hereinafter, with reference to figures, the embodiment of the present invention will be explained in more detail.

As shown in FIG. 1, a spout unit 1 of the present invention comprises a spout 20 and a cap 2, which screws together with a cylindrical opening 21 formed on the top of the spout 20 to open and close the opening 21. In the spout unit 1, viewing from above the cap 2, the cap 2 is screwed in the opening 21 to close the opening 21 when the cap 2 is rotated clockwise "Y", while the cap 2 is removed from the spout 20 when the cap 2 screwed together with the opening 21 is rotated counterclockwise "X".

Figure 4A:
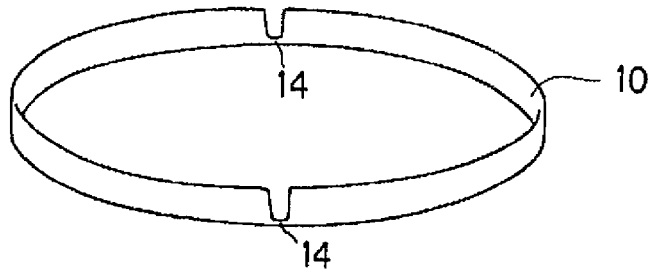
FIG. 4A is a perspective view showing one example of a constitution of an easy-to-break portion of a tamper-proof ring constituting a spout unit of the present invention.
Figure 4B:
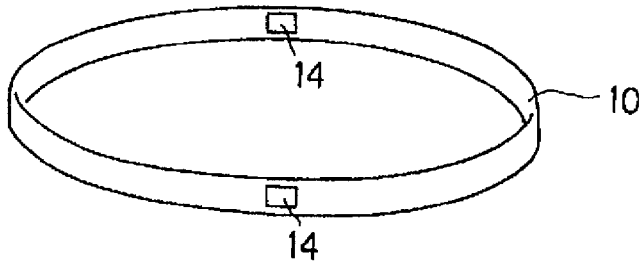
FIG. 4B is a perspective view showing one example of a constitution of an easy-to-break portion of a tamper-proof ring constituting a spout unit of the present invention.
Figure 4C:
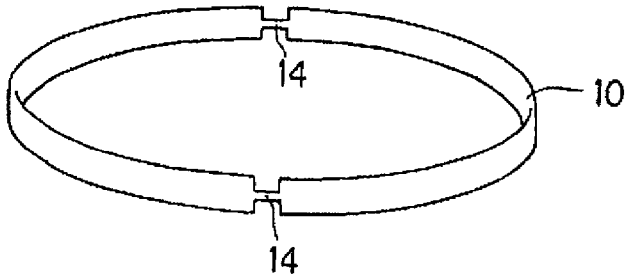
FIG. 4C is a perspective view showing one example of a constitution of an easy-to-break portion of a tamper-proof ring constituting a spout unit of the present invention.

FIGS. 2 to 4 are concerning the cap. Specifically, FIG. 2 shows a partial front view of the cap and a partial longitudinal section view of the cap. FIG. 3 is a cross-sectional view of a tamper-proof ring viewed from above. Each of FIGS. 4A to 4C shows a specific example of an easy-to-break portion of the tamper-proof ring.

As shown in FIG. 2, the cap 2 comprises a cap body 3 and an annular tamper-proof ring 10 connected with a lower end portion of the cap body 3. The cap body 3 is cylindrically formed and comprises a disk-shaped top portion 4 closing the top of the cap and a skirt part 8 forming a side surface of the cap. A lower part of the skirt part 8 may be in a tapered form 8*a*, which enlarges downward. A spiral internal thread 5 is formed at an inner circumference surface of the cap body 3. The internal thread 5 is designed to be screwed together with a spiral external thread 22 formed on the outer circumference surface of the opening 21 of the spout 20 to open and close. On the outer circumference surface of the cap body 3, a longitudinal groove-shaped knurl 7 is formed as a brace.

A toroidal annular protrusion 6 may be provided to an inner surface of a disk-shaped top portion 4. The annular protrusion 6 fits inside of the opening 21 and functions as a packing when screwing the cap 2 together with the opening 21 so as to secure sealing performance.

As shown in FIG. 2, an annular tamper-proof ring 10 is provided with an easy-to-break portion 14, which easily breaks when tension is applied in the circumferential direction of the ring, at least at one spot on the ring. The ring itself breaks at the easy-to-break portion 14 upon opening the spout so that the ring is opened. Also, though it is not shown in FIG. 2, the tamper-proof ring 10 is provided with a claw part at least at one point of the inner circumference surface of the ring. The claw part has an important function when the ring breaks at the easy-to-break portion 14 upon unsealing.

FIG. 3 shows one example of a constitution of the tamper-proof ring 10. In the example, the tamper-proof ring 10 has an annular structure in which two arc-shaped ring pieces 11 are connected at each end with an easy-to-break portion 14. These two easy-to-break portions 14 are arranged with an interval of 180° with respect to the central axis of the cap 2. Also, in the example, tapered approximate trapezoidal claw parts 15 and 16 are projected slightly inclining to the unsealing direction "X" at an inner circumference surface of each ring piece 11.

A structure of the easy-to-break portion 14 may not be particularly limited if the structure has strength to connect each end of two ring pieces 11 each other when the cap is sealed and has weakness to cut each end of two ring pieces 11 when the cap is unsealed. For instance, as shown in FIGS. 4A, 4B and 4C, the easy-to-break portion 14 may be in a form having a missing part in width and/or thickness direction of the ring. Herein, the form having the missing part in the width direction of the ring means a form having a part narrower in width than other part in the circumferential direction of the ring as shown in FIGS. 4A and 4C, or a form having a part same in width as other part in the circumferential direction of the ring, in which each end of the ring in the width direction is not missing and continues, but a middle portion of the ring in the width direction is not connected (hole), as shown in FIG. 4B. The form having the missing part in the thickness direction of the ring means a form having a part which is formed so that the thickness of the ring is thin.

Also, as other structure of the easy-to-break portion 14, there may be a form having a part same in width as other part in the circumferential direction of the ring, in which a material of the easy-to-break portion 14 is deteriorated by means such as a partial heat treatment or the like so as to be easy to break.

In the example shown in FIG. 3, a position of one claw part 15 to be formed in the ring piece 11 is a position which is a backside of the easy-to-break portion 14 ("Y" direction side) upon rotating the cap sealing the spout in the unsealing direction ("X" direction) and is relatively near the easy-to-break portion 14. A position of the other claw part 16 to be formed in the ring piece 11 is a position which is a backside of the easy-to-break portion 14 ("Y" direction side) upon rotating the cap sealing the spout in the unseating direction ("X" direction) and is slightly behind the claw part 15. The claw parts 15 and 16 of two ring pieces 11 are arranged so that the claw part 15 formed on one ring piece 11 and the claw part 15 formed on the other ring piece 11, and the claw part 16 formed on one ring piece 11 and the claw part 16 formed on the other ring piece 11 are respectively symmetry with respect to the central axis of the cap 2.

When the cap 2 sealing the spout is rotated in the unsealing direction "X", the claw parts 15 and 16 in the inner circumference surface of the tamper-proof ring 10 engage with ratchets 41 and 43 provided to the spout (see FIG. 1) respectively, and tension occurs in the circumferential direction of the tamper-proof ring 10. As the result, the tamper-proof ring 10 breaks at the easy-to-break portion 14 so as to exhibit the unseal-warning function of the cap.

The claw parts 15 and 16 at the inner circumference surface of the tamper-proof ring 10 (see FIG. 3) and the ratchets 41 and 43 provided at the spout (see FIG. 1) may be arranged so that all claw parts and all ratchets engage simultaneously when the cap 2 in the sealed condition is rotated in the unsealing direction "X" (see FIG. 11B).

As other arrangement, for instance, the claw parts and the ratchets may be relatively arranged so that when some claw parts among two or more claw parts provided at the inner circumference surface of the tamper-proof ring 10 are in the position to engage with the ratchets provided at the spout side, the other claw parts are in the position not to engage with the ratchets such as the unseal confirmation structure of the cap disclosed in JP-A No. 2004-51195, particularly the structure typically shown in FIG. 4 of JP-A No. 2004-51195.

One or more parts of the tamper-proof ring 10 are connected with a lower end portion of a skirt part 8 of the cap 2 via an easy-to-break linking piece 12. As shown in FIG. 2, not only the above-mentioned one or more connected parts between the tamper-proof ring 10 and the lower end portion of the skirt part 8 of the cap 2 via the easy-to-break linking piece 12 but also one or more connected parts via a noncleavable linking piece 13 may exist therebetween.

In the example shown in FIG. 3, in each ring piece 11, four easy-to-break linking pieces 12 are provided with an even interval starting from the position which is a backside of the easy-to-break portion 14 ("Y" direction side) upon rotating the cap sealing the spout in the unsealing direction ("X" direction) and is relatively near the easy-to-break portion 14. The noncleavable linking piece 13 is provided at the fifth position most backward of the above four easy-to-break linking pieces 12 with the same interval. The fifth position where the noncleavable linking piece 13 is provided is also a position near a frontward of the following easy-to-break portion. In the example shown in FIG. 3, the island-shaped easy-to-break linking pieces 12 are arranged with even interval, however, the form of the easy-to-break linking piece may be long and consecutive in the circumferential direction of the ring if the easy-to-break linking piece can be broken upon unsealing.

A structure of the easy-to-break linking piece 12 may not be particularly limited if the easy-to-break linking piece 12 has strength to connect the annular tamper-proof ring 10 to the lower end portion of the skirt part 8 when the cap is sealed, and has weakness to break by tension applied to the tamper-proof ring 10 when the cap is unsealed. In order to impart such a weakness, a length (connecting length) of the easy-to-break linking piece 12 along the circumferential direction of the tamper-proof ring 10 may be relatively shortened or a thickness of the easy-to-break linking piece 12 may be thinned.

On the other hand, a structure of the noncleavable linking piece 13 may not be particularly limited if the noncleavable linking piece 13 has strength to connect the annular tamper-proof ring 10 to the lower end portion of the skirt part 8 when the cap is sealed, and has strength not to break by tension applied to the tamper-proof ring 10 so as to hold connection between the cap body and the tamper-proof ring when the cap is unsealed.

If the tamper-proof ring 10 and the lower end portion of the skirt part 8 of the cap 2 are only connected via the easy-to-break linking pieces 12, the tamper-proof ring 10 completely separates from the cap body in the open process. Thus, the unsealed condition is less obvious than the case when remains of the tamper-proof ring 10 after breakage is attached to the cap body. Also, if the remains of the tamper-proof ring 10 after breakage is completely separated from the cap body, small remains is likely to scatter as garbage. To the contrast, the tamper-proof ring 10 and the lower end portion of the skirt part 8 of the cap 2 are connected with the easy-to-break linking piece 12 in some part and the noncleavable linking piece 13 in other part, the remains of the tamper-proof ring 10 after breakage attaches to the cap body so that the unsealed condition is more obvious the above-mentioned case. Hence, the unseal-warning function is effectively exhibited by the tamper-proof ring. It is also an advantage that the remains is less likely to scatter and becomes easy to collect the remains as garbage if the remains of the tamper-proof ring 10 after breakage is attached to the cap body.

If the noncleavable linking piece 13 is provided to connect the tamper-proof ring 10 and the lower end portion of the skirt part 8 of the cap 2, the noncleavable linking piece 13 needs to be provided at a position which does not prevent breakage (ring opening) of the tamper-proof ring 10 upon unsealing. Specifically, as shown in FIG. 3, in each ring piece 11, the tamper-proof ring 10 is connected to the lower end portion of the skirt part 8 of the cap 2 with the easy-to-break linking piece 12 at the position which is a backside of the easy-to-break portion 14 ("Y" direction side) upon rotating the cap sealing the spout in the unsealing direction ("X" direction) and is relatively near the easy-to-break portion 14. The tamper-proof ring 10 is connected to the lower end portion of the skirt part 8 of the cap 2 with the noncleavable linking piece 13 at the position which is a backside of the easy-to-break portion 14 ("Y" direction side) upon rotating the cap sealing the spout in the unsealing direction ("X" direction) and is father from the easy-to-break portion 14 than the easy-to-break linking piece 12 in each ring piece 11.

By arranging the easy-to-break linking piece 12 and the noncleavable linking piece 13 in each ring piece 11 in the above-mentioned relative positional relationship with reference to the position of the easy-to-break portion 14, the tension occurring in the circumferential direction of the tamper-proof ring 10 upon rotating the cap sealing the spout in the unsealing direction will not be inhibited by the noncleavable linking piece 13 and effectively works to the easy-to-break portion 14 and the easy-to-break linking piece 12. Therefore, the easy-to-break portion 14 and the easy-to-break linking piece 12 surely break.

Figure 5:
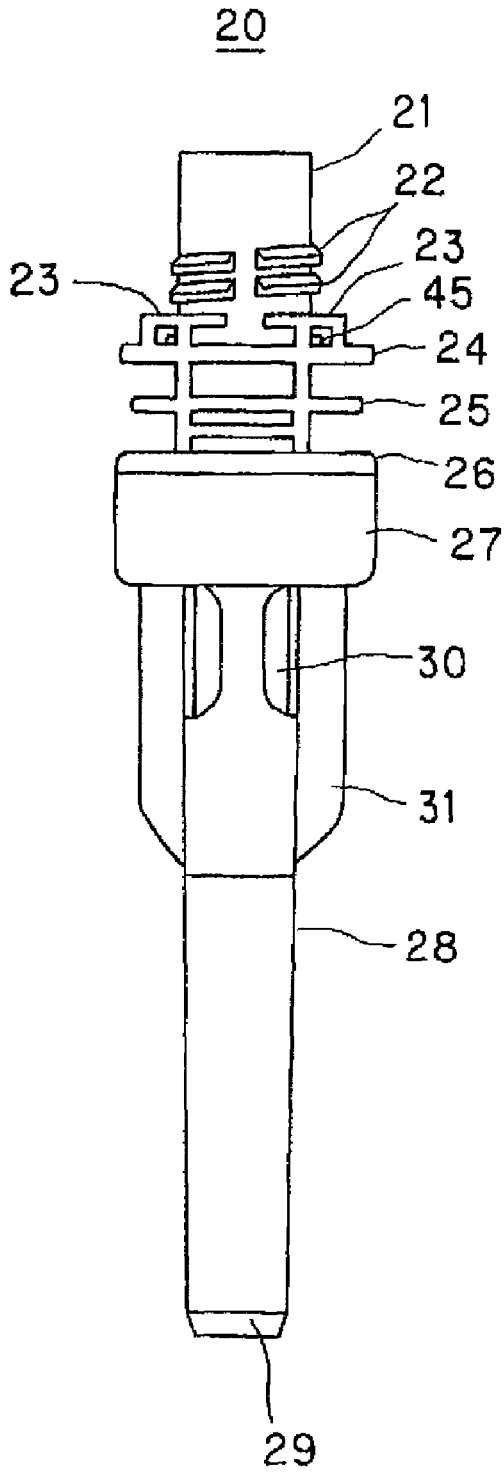
FIG. 5 is a front view showing a spout constituting a spout unit of the present invention.
Figure 6:
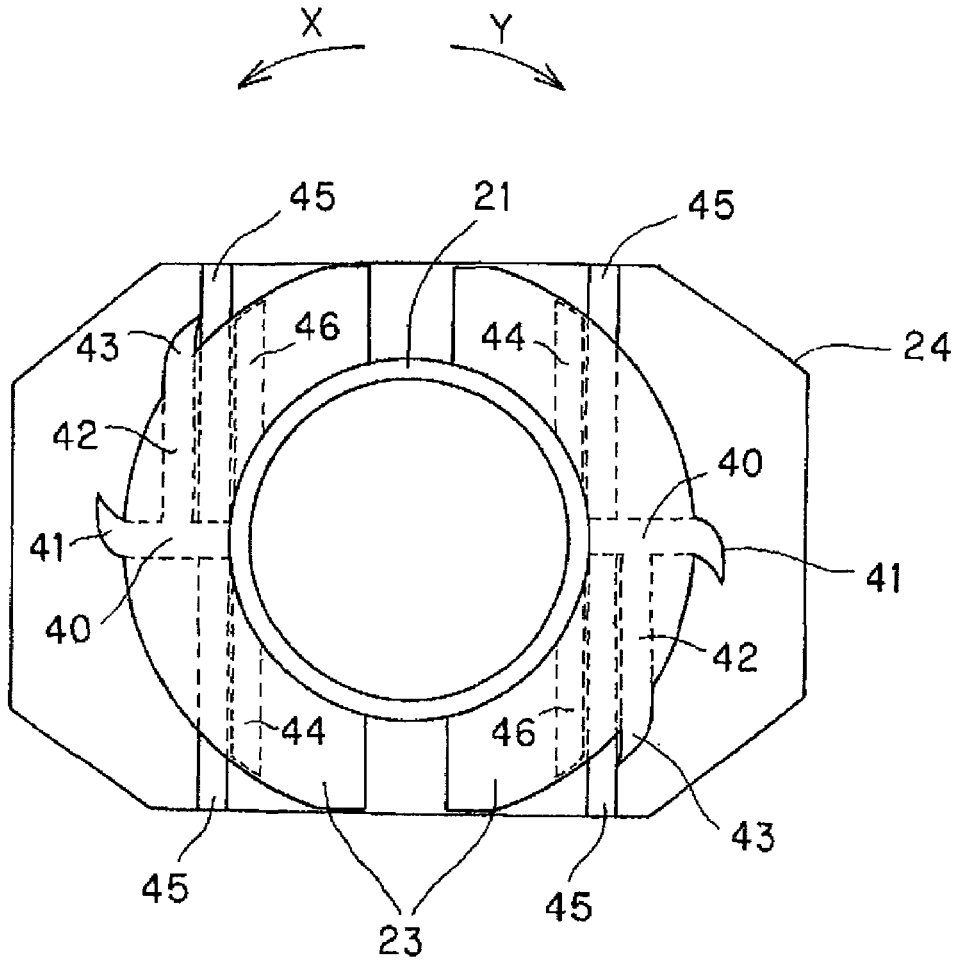
FIG. 6 is an overhead view showing a constitution near a base of a spout constituting a spout unit of the present invention.

Next, FIGS. 5 and 6 are concerning constitution of the spout unit of the present invention. FIG. 5 is a front view showing one example of constitution of the spout. FIG. 6 is an overhead view showing a form of a stopper and a base of the spout, a rib formed therebetween, a tamper-proof ring support projected from the base, and a ratchet formed at the tip of the rib, and a positional relationship thereof.

As shown in FIGS. 5 and 6, the spout 20 has a cylindrical opening 21 which screws together with the cap 2 on the top of the spout 20. Ratchets 41 and 43 are provided around the proximity of the lower part of the opening 21. A tamper-proof ring support 45, which supports the tamper-proof ring from underneath, is provided around the lower position than the position where the ratchets 41 and 43 of the opening 21 are provided. Further, the spout 20 may have a base comprising one or more base flanges which stretch horizontally from the lower part of the outer circumference surface of the opening and a stopper 23 comprising a flange which stretches horizontally from a position higher than the base at the outer circumference surface of the opening. In the example shown in FIGS. 5 and 6, the base has three base flanges 24, 25 and 26 which form a vertically three-layered structure. A structure of the stopper 23 has a pair of fan-shaped flanges, the flanges of which are disposed on the right and left side of the opening.

Further, the spout 20 may have a thin, long and cylindrical straw part 28 disposed below the opening 21. The spout 20 may have a mounting part 27, which is attached to the upper end of a bag body "A", between the opening 21 and the straw part 28 right below the lowest base flange 26 of the opening 21. The straw part 28 is in thin, long and cylindrical form and is inserted inside of the bag body "A" in a form of bag (see FIG. 1). An aperture 29 is formed at the bottom end of the straw part 28. A side surface of the straw part 28 has one or more long holes 30 which are in communication with inside and outside of the straw part 28.

Also, in the straw part 28, plate members 31, which stretch horizontally at both sides of the straw part 28, are provided at positions corresponding to the long holes 30 in the axial direction. The plate members 31 function to secure a path to the aperture 29 and the long hole 30 when the bag body "A" is squeezed and to have the inner content enter into the straw part 28. The mounting part 27 is formed so that the length in the cross direction with respect to the surface of the bag body "A" includes the diameter of the straw part 28 and to stretch out right and left (see FIG. 1). The outer surface of the mounting part 27 and the upper end of the bag body "A" are stuck together so that no gap is formed between the outer surface of the mounting part 27 and the upper end of the bag body "A" and a hermetically-sealing function is provided.

The opening 21 is formed cylindrically. A spiral external thread 22 is formed at an outer circumference surface thereof. The external thread 22 engages with the internal thread 5 formed at the inner circumference surface of the cap 2 and lets the cap 2 screw into the opening 21. Thereby, the cap 2 can be detachably mounted on the opening 21 of the spout 20 for the cap.

The base flanges 24, 25 and 26 are arranged so as to form a vertically three-layered structure. Each of the base flanges 24, 25 and 26 is formed in an octagon shape which is horizontally long right and left as shown in FIG. 6 and has a structure that stretches horizontally from the outer circumference surface of the opening 21 around the opening 21. Since the bottom surface of the bottom base flange 26 contacts with the upper end of the bag body "A", such a base flange 26 prevents the spout 20 for the cap from dropping inside of the bag body "A" in the production process.

The ratchet is provided around the proximity of the lower part of the opening 21. The ratchet contacts with the claw part at the inner circumference surface of the tamper-proof ring at a position slightly above a screwable lowest position when the cap is screwed into the opening. The claw part can go over the ratchet if the cap is rotated further to the sealing direction so as to complete sealing of the opening. However, when the cap is rotated in the unsealing direction after the claw part at the inner circumference surface of the tamper-proof ring goes over the ratchet and the sealing of the opening by the cap is once complete, the claw part and the ratchet of the tamper-proof ring engage right after the start of rotation to the unsealing direction. Hence, the cap cannot be further rotated to the unsealing direction unless the tamper-proof ring is broken.

In the example shown in FIG. 6, a pair of fan-shaped stoppers 23 has a structure in which the stoppers stretch horizontally right and left from the outer circumference surface of the opening 21 around the opening 21. An outer edge of each stopper 23 is formed to be located at an inner side of an outer edge of the top base flange 24. The stopper 23 is arranged at a higher location than the top base flange 24 with a certain distance. A gap is formed between the stopper 23 and the top base flange 24. Plural ribs 40, 42, 44 and 46 are formed at the gap of each stopper so as to connect the top base flange 24 and the stopper 23.

Each rib 40 of the pair of fan-shaped stoppers 23 extends right and left from the outer circumference surface of the opening 21. A tip of each rib 40 projects to the outer side of the outer edge of the stopper 23 and is the ratchet 41 engageable with the tapered approximate trapezoidal claw part 15 formed at the inner circumference surface of the ring piece 11 constituting the tamper-proof ring 10 of the cap 2.

Also, each rib 42 of the pair of fan-shaped stoppers 23 extends from an intermediate position between a root and the tip of the rib 40 to a peripheral of the stopper 23 at right angle with the rib 40. The tip of each rib 42 projects to the outer side of the outer edge of the stopper 23 and is the ratchet 43 engageable with the tapered approximate trapezoidal claw part 16 formed at the inner circumference surface of the ring piece 11 constituting the tamper-proof ring 10 of the cap 2. Further, each rib 44 and each rib 46 of the pair of fan-shaped stoppers 23 are formed at the opening 21 side of the tamper-proof ring support 45 in parallel with the tamper-proof ring support 45 so that the rib 44 of one stopper 23 and the rib 46 of another stopper 23 faces across the opening 21.

The ratchets 41 and 43 are formed in approximate trapezoid tapered to the tip when viewed in a cross section, projected outer side from the outer edge of the stopper 23, disposed at a position wherein the ratchets 41 and 43 of one stopper 23 and the ratchets 41 and 43 of another stopper 23 are rotationally symmetric with respect to the opening 21 as the central axis, and have a slightly inclined form to the reverse side of the unsealing direction "X" of the cap 2. Due to the above-mentioned form of the ratchets 41 and 43, the claw part of the inner circumference surface of the tamper-proof ring can go over the ratchet when rotating the cap in the sealing direction "Y", and the claw part and the ratchet can engage when the cap is rotated in the unsealing direction "X".

In the example shown in FIG. 6, the ratchets 41 and 43 are formed to project the rib between the stopper 23 and the top base flange 24. The ratchets may be formed to project from the outer edge of the stopper 23. Also, the ratchets may be projected by integrally forming the outer edge of the stopper and the rib extending between the stopper and the base.

Figure 7:
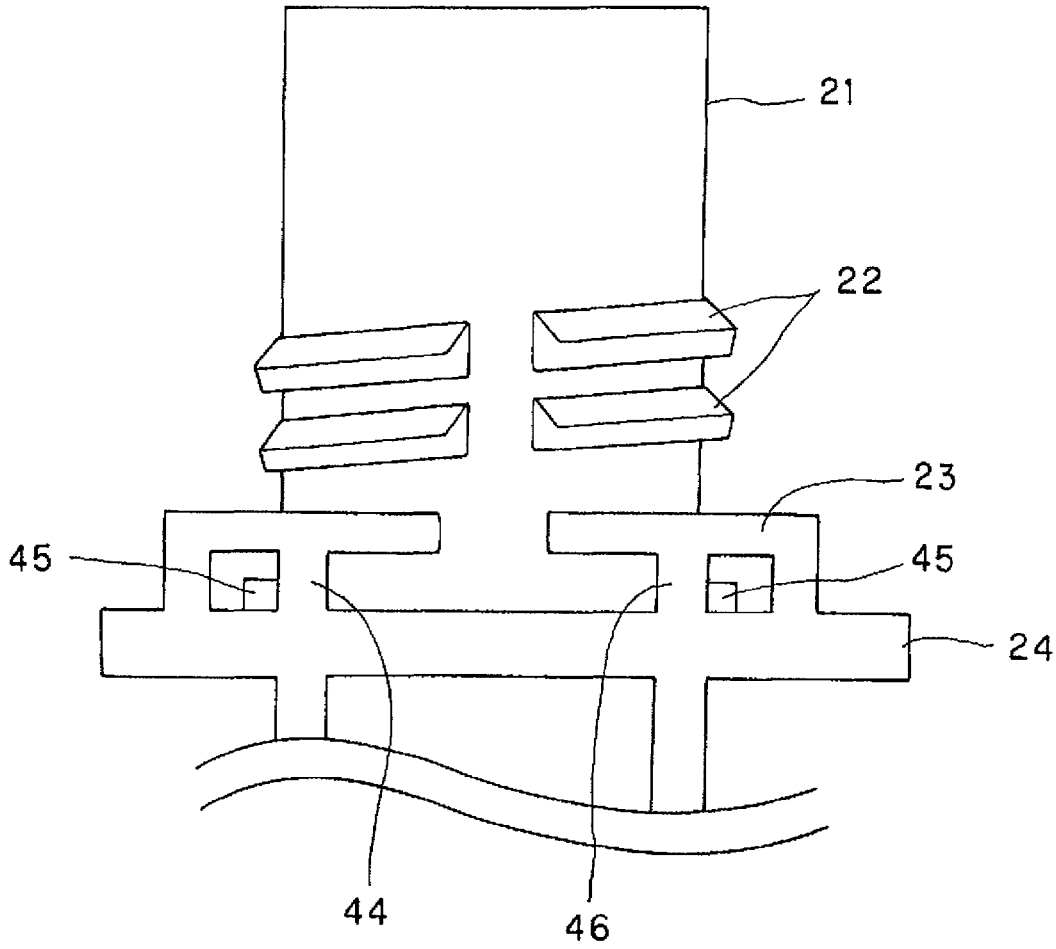
FIG. 7 is a partially enlarged front view showing an opening constituting a spout unit of the present invention.
Figure 8:
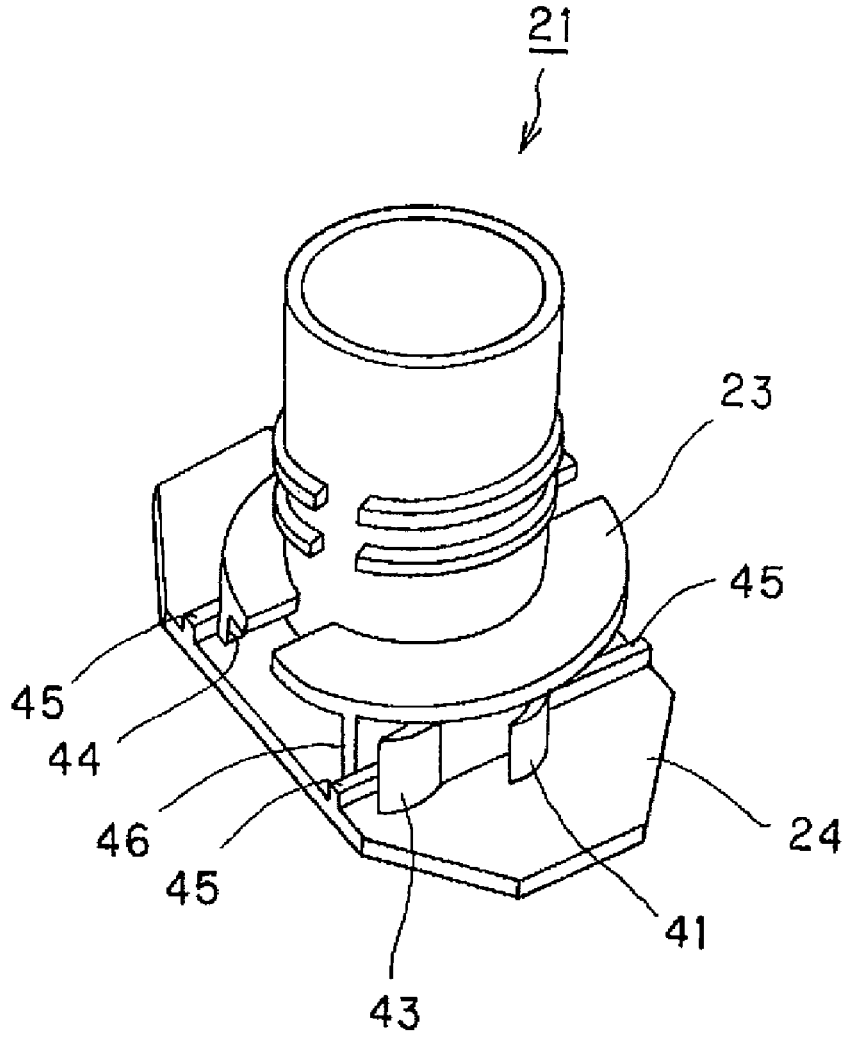
FIG. 8 is a partially enlarged perspective view showing an opening constituting a spout unit of the present invention.

The tamper-proof ring support may be provided at two places around the proximity of the lower part of the opening 21. In the example shown in FIG. 6, the tamper-proof ring supports 45 are formed to project at four places on the upper surface of the top base flange 24. FIG. 7 is an enlarged front view of the opening 21 comprehensively showing a position of the tamper-proof ring support 4 shown in FIG. 6. Further, FIG. 8 is an enlarged perspective view, when the opening 21 is viewed from upward, comprehensively showing a position and a form of the tamper-proof ring support 45 shown in FIG. 6.

Figure 9:
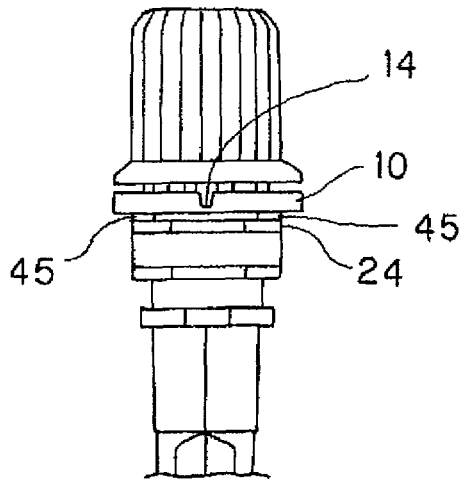
FIG. 9 is a partially enlarged side view showing a spout unit of the present invention in a sealed condition.
Figure 10:
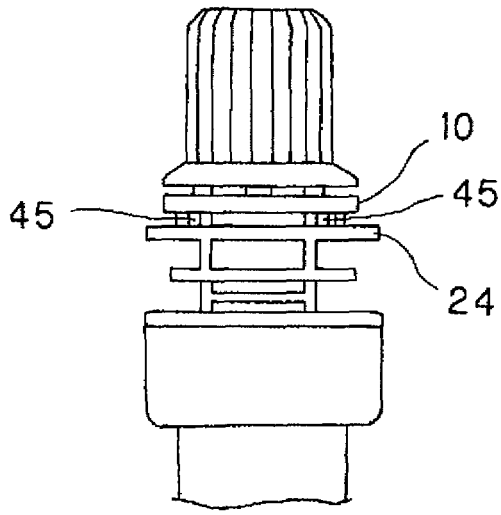
FIG. 10 is a partially enlarged front view showing a spout unit of the present invention in a sealed condition.
Figure 14:
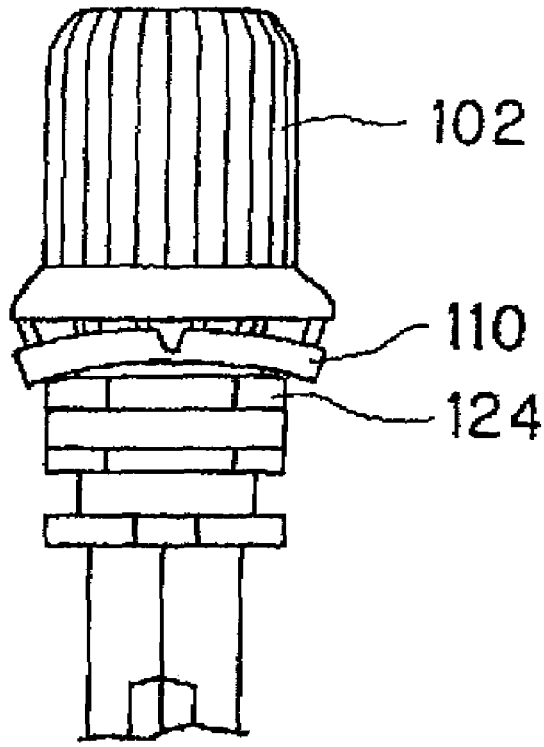
FIG. 14 is a side view showing a state of a conventional tamper-proof ring of a spout unit modified into a moderate curve in convex.

According to the present invention, as shown in a front view in FIG. 9 and a side view in FIG. 10, modification of moderate curve in convex (slightly shallow arc) from the easy-to-break portion 14 (see FIG. 14) can be corrected since the tamper-proof ring supports 45 provided around the proximity of the lower part of the opening 21 support the tamper-proof ring 10 when the spout 20 is sealed by the cap 2.

Also, since the tamper-proof ring support 45 is only contacting a partial region of the bottom of the tamper-proof ring 10, friction resistance does not increase excessively upon unsealing. Hence, the present invention can open the cap with less force in comparison with the case correcting the modification of the tamper-proof ring by completely removing the gap between the bottom of the tamper-proof ring and the upper surface of the top base flange 24.

Also, according to the present invention, if the cap 2 is sealed again with the remains of the tamper-proof ring 10 attached after the spout 20 is once unsealed, the remains of the tamper-proof ring slips away from the tamper-proof ring support 45 even in the state that the cap is screwed to the lowest level since there is the gap between the bottom of the remains of the tamper-proof ring and the top base flange 24. Hence, the condition that the ring has already been broken is obvious and the tamper-proof function can be effectively exhibited. Therefore, according to the present invention, the spout unit with the tamper-proof function having high commercial value can be provided.

A form of the tamper-proof ring support 45 may not be particularly limited. For instance, as shown in FIG. 6, if a convex tamper-proof ring support 45 is provided between the rib 42 and the rib 46, a part of the bottom of the tamper-proof ring 10 partially contacts with the convex tamper-proof ring support 45 to be supported in the sealed condition.

From the viewpoint of surely correcting the tamper-proof ring, the tamper-proof ring support 45 is provided at two or more places on the upper surface of the top base flange 24, preferably 3 to 6 places, more preferably 3 to 5 places, further more preferably 4 places.

It is preferable that an interval of the plural tamper-proof ring supports 45 is equiangularly provided so that the interval is even, but may be slightly uneven in the range of 15 to 60°. A width of the tamper-proof ring support 45 is preferably 0.5 to 2.0 mm but may also be a width wherein a contacting area of the bottom portion 17 of the tamper-proof ring 10 is not too large and friction in the unsealing direction "X" does not increase excessively.

Also, the tamper-proof ring support 45 can be provided on the upper surface of the top base flange 24, wherein a height of the tamper-proof ring support 45 at highest in the unsealed condition of the spout unit 1 is a value subtracting a height of the tamper-proof ring 10 and a height of the easy-to-break linking piece 12 or the noncleavable linking piece 13 from a height between the lower end portion 9 of the skirt part 8 of the cap 2 and the upper surface of the top base flange 24. There may be looseness allowing a slipping property of the tamper-proof ring 10.

The tamper-evident (tamper-proof) function of the spout unit 1 of the present invention is exhibited as shown in FIGs. 11A to 11D. FIGS. 11A to 11D are views showing steps from the beginning of an open process of the spout unit in the sealed condition to breaking of the easy-to-break portion 14 of the tamper-proof ring 10. As shown in FIG. 11A, in the spout unit 1 of the present invention of the sealed condition, the claw part 15 and the ratchet 41 face at a slight gap from each other and the claw part 16 and the ratchet 43 face at a slight gap from each other.

As shown in FIG. 11B, when the cap 2 is rotated in the unsealing direction "X" (counterclockwise) with respect to the spout 20, the claw part 15 engages with the ratchet 41 and, at the same time, the claw part 16 engages with the ratchet 43. From this condition, as shown in FIG. 11C, when the cap 2 is further rotated in the unsealing direction "X", tension occurs in the circumferential direction of the tamper-proof ring 10 so that the tamper-proof ring 10 breaks at the easy-to-break portion 14 as shown in FIG. 11D.

Also, almost as simultaneously as the easy-to-break portion breaks, the easy-to-break linking piece 12 connecting the tamper-proof ring 10 and the cap body 3 breaks. Thus, the tension in the circumferential direction of the ring is effectively applied at the position of the easy-to-break portion 14 of the tamper-proof ring 10, thereby, the easy-to-break portion 14 is surely broken.

On the other hand, other linking piece connecting the tamper-proof ring 10 and the cap body 3, that is, the noncleavable linking piece 13, does not break in the open process. Thus, the remains of the tamper-proof ring 10 remains on the cap body after completion of unsealing.

The spout unit of the present invention can be used by connecting the spout unit to a container body with various form or structure. A material of the container body may be paper, resin, metal or combination thereof. A form of the container body may be tubular, bottle-shaped, bag-shape or the like and may not be particularly limited. For instance, in the spout unit 1 of the present invention as shown in FIG. 1, the aperture on the top of the bag body "A" comprising a gusset bag formed with a flexible layered film and the mounting part 27 of the spout 20 constituting the spout unit can be joined to use. Upon taking out the inner content from the container, the screw between the cap 2 and the opening 21 is unfastened to open and the opening 21 is used as a pouring opening. As shown in FIG. 12, when a tip of a straw part 28 reaches near the bottom of the bag body "A", the spout unit 1 can be used as a straw so that the inner content can be sucked up by a mouth applied to the cylindrical opening 21.

What is claimed is:

1. A spout unit comprising a spout having a cylindrical opening and a cap which screws into the opening of the spout to seal the opening, wherein the cap has a cylindrical cap body and a tamper-proof ring connected to a lower end portion of a skirt part of the cap body via an easy-to-break linking piece;

wherein an easy-to-break portion, which breaks the ring by tension applied in the circumferential direction of the ring, is provided at least at a part of the tamper-proof ring, and a claw part is provided at least at one point of inner circumference surface of the tamper-proof ring; and wherein a ratchet, which is engageable with the claw part of the tamper-proof ring when rotating the cap of sealed condition in the unsealing direction, and in which the claw part is able to go over the ratchet when the cap is rotated in the sealing direction, is provided around the opening of the spout, and a tamper-proof ring support is provided at least at two points around the opening, in which the tamper-proof ring support is in partial contact with undersurface of the tamper-proof ring upon screwing the cap and has a height to maintain a position of the tamper-proof ring in horizontal direction at a constant level; wherein the spout has the opening, a base comprising one or more flanges which stretches horizontally at a lower part of the outer circumference surface of the opening, and a stopper which stretches horizontally at a higher position than the base of the outer circumference surface of the opening; wherein the ratchet is provided at an outer edge of the stopper and/or between the stopper and the base; and wherein the tamper-proof ring support is provided on an upper surface of a top flange of the one or more flanges.

2. The spout unit according to claim 1, wherein the easy-to-break portion of the tamper-proof ring is formed to have a missing part in the width and/or thickness direction of the ring.

3. The spout unit according to claim 1, wherein the stopper is in a form of a pair of fans stretching out right and left from the outer circumference surface of the opening.

4. The spout unit according to claim 1, wherein a lower end portion of a skirt part of the cap body and the tamper-proof ring are connected with the easy-to-break linking piece in some part and with a noncleavable linking piece in other part; and wherein the tamper-proof ring is connected to the lower end portion of the skirt part of the cap body by:

the easy-to-break linking piece at rearward side of the easy-to-break portion when the cap sealing the spout is rotated in the unsealing direction and at a relatively proximal position to the easy-to-break portion, and the noncleavable linking piece at rearward side of the easy-to-break portion when the cap sealing the spout is rotated in the unsealing direction and at a position which is farther than the easy-to-break linking piece.

5. The spout unit according to claim 1, wherein the spout for the cap further has an elongate cylindrical straw part beneath the opening.

6. A bag comprising a spout unit defined in any of claims 1 to 5 and a bag body connected with the spout unit.

* * * * *